US006572484B1

(12) United States Patent
Iverson

(10) Patent No.: US 6,572,484 B1
(45) Date of Patent: Jun. 3, 2003

(54) TABLE FOR A BOWLING CENTER

(76) Inventor: Mark Thomas Iverson, 2505 N. Rockwell Ave., Chicago, IL (US) 60647

( * ) Notice: Subject to any disclaimer, the term of this patent is extended or adjusted under 35 U.S.C. 154(b) by 407 days.

(21) Appl. No.: 09/156,060

(22) Filed: Sep. 17, 1998

(51) Int. Cl.[7] ..... A63D 1/00
(52) U.S. Cl. ..... 473/54
(58) Field of Search ..... 473/54, 116; D6/482, D6/486, 487

(56) References Cited

U.S. PATENT DOCUMENTS

| | | | | |
|---|---|---|---|---|
| D196,121 | S | * 8/1963 | Soszynski | D6/337 |
| D339,487 | S | * 9/1993 | Rizzi | D6/486 |
| D401,086 | S | * 11/1998 | Hellwig et al. | D6/429 |
| D413,212 | S | * 8/1999 | Dame et al. | D6/487 |

FOREIGN PATENT DOCUMENTS

| | | | |
|---|---|---|---|
| JP | 10155967 | * | 6/1998 |
| WO | 9621915 | * | 7/1996 |

OTHER PUBLICATIONS

Wholesale Furniture Catalog M–952, p. M–52, upper right corner of page, received Jul. 6, 1995, located in "Office Furniture" boxes in Design Library.*

IKEA Catalog, 1991, p. 76, upper right corner of page, located in "IKEA" boxes in Design Library.*

Brunswick Bowling Catalog Supplies and Equipment, pp. 30 and 31, 1952.*

* cited by examiner

*Primary Examiner*—William M. Pierce
(74) *Attorney, Agent, or Firm*—Lloyd L. Zickert

(57) ABSTRACT

A table for a bowling establishment or center having a size and shape for use by patrons during bowling and being positioned relative the lane approach section and the ball return rack to provide space for scoring, eating food, drinking beverages, and allowing ease of access for bowling.

13 Claims, 2 Drawing Sheets

TABLE FOR A BOWLING CENTER

This invention relates in general to a table for a bowling center, and more particularly to an improved table for bowlers and friends that allows them to sit at and which provides for ample space for the consumption of food and beverages while facilitating ease of access to the lanes.

BACKGROUND OF THE INVENTION

Bowling has been and remains a popular sport or hobby for many people. While the decorum of bowling centers or establishments that have bowling lanes may vary greatly, the layout of the bowling areas is substantially the same in all establishments or centers. The bowling areas are divided into three distinct but interrelated sections: the bowling lanes section, the approach section, and the sitting/scoring section. Persons patronizing bowling centers will generally be referred to herein as patrons, which include bowlers, friends, and other people having bowling interests.

The first or bowling lanes section normally includes a plurality of bowling lanes that are subgrouped into pairs of lanes. Each lane includes a bowling lane or surface and a gutter on each side of the bowling lane. A ball return section including a ball return track is disposed between each lane of a pair of lanes, while a capping is located between each adjacent pair of lanes. The total width of a pair of lanes between the median of consecutive capping sections is about 133½ inches. That width can be broken down into two lanes that are 42 inches wide, four gutters (2 on each lane) that are each 9½ inches wide, a ball return section that is also 9½ inches wide, and half of two capping sections that are each 2 inches wide.

The ball return track extends the length of the lanes and into the approach section, where it extends upward to deposit or return the balls to a ball return rack at a level that allows bowlers to easily pick up their bowling balls. An open area is provided on each side of the ball return rack that represents the approach areas of the approach section. Usually the ball return track is below floor level and emerges upwardly through the floor in the approach area to the ball return rack. The approach section, which extends to the beginning (or foul line) of the bowling lane section, allows a bowler to 'run up' and deliver a ball down the lane without impairments during a bowling turn.

Behind the approach section, generally on a lower level, is a section for the bowlers to sit and keep score. In most centers, a small table is located directly behind the ball return rack for each pair of lanes. The table generally allows one person from each lane to sit and keep score, while offering a few cupholders. The remaining bowlers or friends either stand or sit behind the table in additional seating provided. It has been known that some bowling centers utilize an oval table in the spectator area behind the sitting/scoring section that may seat up to six patrons.

Throughout the years, the services in bowling centers have changed. Instead of merely offering a form of entertainment or sport, bowling establishments now often offer food and drinks as well. Furthermore, it is often common for various organizations or groups to rent out part or all of the bowling lanes for private parties, whereby numerous bowlers might want to bowl on each lane. Generally, only two bowlers or other patrons per pair of lanes may sit at the table. The remaining patrons have to either sit behind the table in whatever seating is available, remain standing, or go to the area behind the bowling area. If the patrons order food or beverages, most have to either hold their food or drinks, or place them in the area behind the bowling platform. This layout is inconvenient for patrons who want to socialize, eat and drink with others at bowling centers.

SUMMARY OF THE INVENTION

The present invention provides a unique solution to the problems mentioned above by providing a table in a bowling establishment or center sized and shaped to serve a pair of lanes with ample space for several patrons to eat food and drink beverages on the table and to allow easy access for moving into the approach areas and about the ball return rack when taking bowling turns. The table is preferably substantially triangular in shape and is located with its apex substantially in line with and adjacent to the ball return rack between the lanes of a pair of lanes. The base of the table is about eight (8) feet wide, with sides of about six and a half (6½) feet. Thus, the location and size of a table allows space for patrons to walk between adjacent tables and along the tables to the approach sections, and around the ball return rack. Each table provides ample space to accommodate at least six patrons.

It is therefore an object of the present invention to provide an improved bowling table for a bowling area in a bowling center that is sized, shaped and located in the sitting/scoring section to allow a plurality of patrons to sit around and comfortably eat food and/or drink beverages while providing easy access to the approach section.

Another object of the present invention is to provide a bowling table that does not interfere with the movement of the patrons in approaching the lanes and movement between lanes.

Other objects, features and advantages of the invention will be apparent from the following detailed disclosure, taken in conjunction with the accompanying sheets of drawings, wherein like reference numerals refer to like parts.

DESCRIPTION OF THE INVENTION

Figure 1:
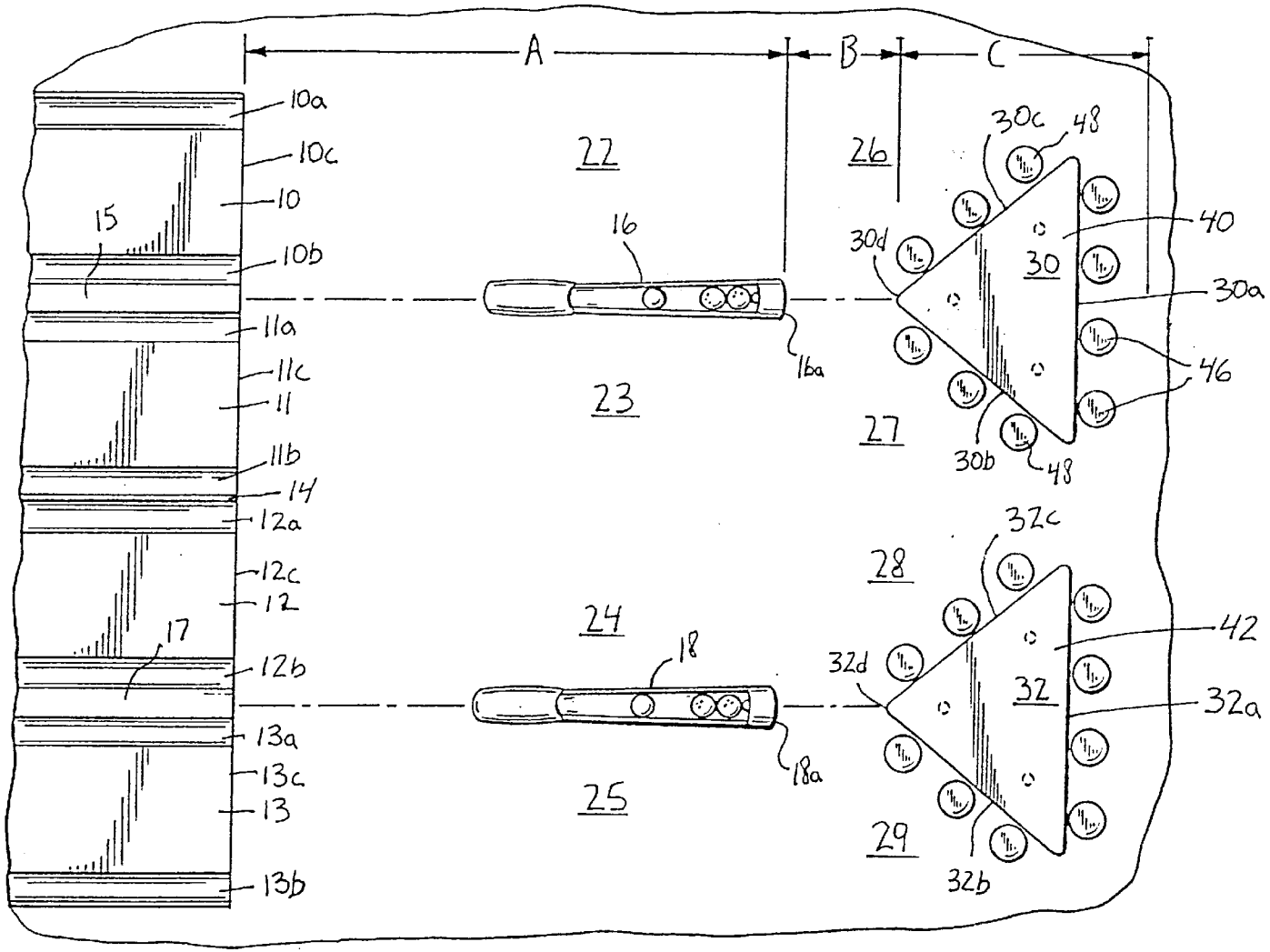
FIG. 1 is a fragmentary top plan view of two pair of bowling lanes in a bowling center with tables according to the present invention to show the relative placement of the tables to the bowling lanes and ball return section.
Figure 2:
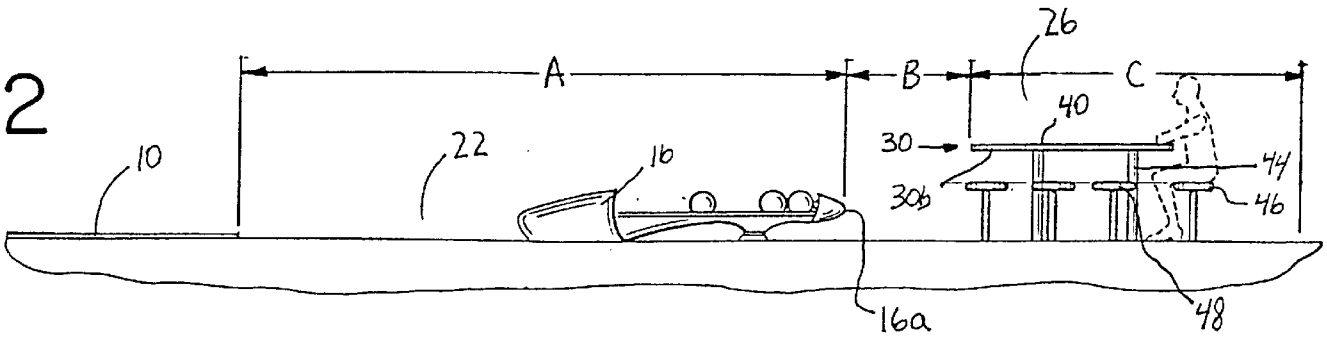
FIG. 2 is an elevational side view taken along line 2—2 of FIG. 1 to illustrate the spacing between the table and the ball return section and the beginning of the bowling lane.

Referring now to the drawings, and particularly to FIGS. 1 and 2, a typical layout in a bowling establishment or center includes a plurality of pairs of bowling alleys or lanes in a bowling lanes section, an approach return where the ball section racks are located, and a sitting/scoring section where the tables according to the invention are located.

The layout illustrated in FIG. 1 shows two pairs of alleys arranged in side-by-side relation. One pair includes alleys or lanes 10 and 11, and the other pair includes alleys or lanes 12 and 13. The alleys respectively include gutters 10*a*, 10*b*, 11*a*, 11*b*, 12*a*, 12*b*, and 13*a*, 13*b* at opposite sides of the alleys or lanes. A capping 14 is provided between the pairs of lanes, and particularly between gutters 11*b* and 12*a*.

The pair of alleys 10 and 11 are serviced by a ball return track 15 that extends beneath the floor and emerges upwardly to a ball return rack 16 that is located in the approach section. Similarly, the lanes 12 and 13 are serviced by a ball return track 17 which emerges to a ball return rack 18 located in the approach section for that pair of lanes.

As seen in FIGS. 1 and 2, the layout showing the approach section is designated as A and extends from the foul lines 10*c*, 11*c*, 12*c* and 13*c* to the back ends 16*a* and 18*a* of the ball return racks 16 and 18. While the approach section A extends to the backs 16*a* and 18*a* of the ball return racks 16 and 18, the approach section may also extend beyond the back ends 16*a* and 18*a* of the ball return racks. The approach section can be divided into individual approach areas 22, 23, 24 and 25. The approach areas are thus immediately adjacent the bowling lanes or bowling lane section to allow the running up of a bowler for releasing a bowling ball to the respective lane during a bowling turn.

With respect to the pair of lanes 10 and 11, approach areas 22 and 23 are disposed at opposite sides of the ball rack 16 to service these lanes. Similarly, with respect to lanes 12 and 13, approach areas 24 and 25 are located at opposite sides of the ball return rack 18 to service those lanes.

Behind the approach section is the sitting/scoring section, generally indicated by dimensions B and C in FIGS. 1 and 2. The sitting/scoring section B and C may be divided into individual sitting/scoring areas 26, 27, 28 and 29. Sitting/scoring areas 26 and 27 service the pair of lanes 10 and 11, while sitting/scoring sections 28 and 29 service the pair of lanes 12 and 13. The sitting/scoring areas extend away from the approach areas a suitable distance for providing an area for locating the tables according to the present invention. As seen particularly in FIG. 1, a table 30 according to the invention is provided to service the lanes 10 and 11 and approach areas 22 and 23, while a table 32 according to the present invention is provided to service lanes 12 and 13 and approach areas 24 and 25. While the tables may take any suitable shape, it is preferable that they be triangular in shape, as illustrated in FIGS. 1 and 2, with side edges that are preferably straight but may be slightly arcuate.

The tables respectively include base or back edges 30*a* and 32*a* and side edges 30*b* and 30*c* and 32*b* and 32*c*. The back or base edges 30*a* and 32*a* extend parallel to the foul lines of the lanes and perpendicular to the long axis of the lanes and the direction of approach to the lanes by the bowler. While the base edges 30*a* and 32*a* are shown as straight, the base edges 30*a* and 32*a* may be arcuate in shape. The side edges of each of the tables extend inwardly from the back edges and toward one another to the apexes 30*d* and 32*d*. The apexes are spaced from the ends 16*a* and 18*a* of the ball return racks a sufficient distance (indicated by dimension B in FIGS. 1 and 2) in order to allow a bowler or patron to easily move between the pair of alleys serviced by the tables so that a bowler may easily use whichever alley designated in the pair of alleys for a bowling turn.

Figure 3:
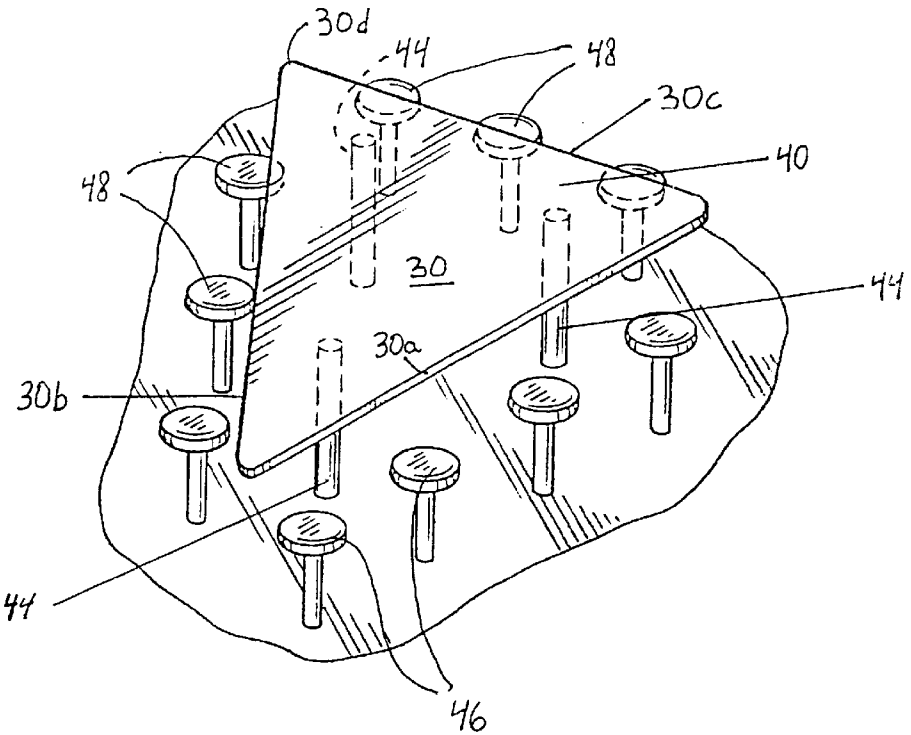
FIG. 3 is a perspective view of the table according to the invention with seating for ten patrons.

Table 30 is shown in perspective in FIG. 3 and includes a tabletop 40, while table 32 includes a tabletop 42. Reference will be made more particularly now to table 30 to illustrate its serviceability to patrons utilizing the table for the respective approach section and lanes, and it will be understood table 32 functions in the same way for the lanes it services. Table 30, which includes tabletop 40, is supported by a plurality of legs 44 at a suitable height which may either be counter height or bar height. Stools or chairs are provided around the edges of the table in order to accommodate patrons using the lanes. Preferably, the size of the table would be such that the rear edge or rear side 40 is about eight feet long and the side edges 30*b* and 30*c* are about six feet six inches long. Accordingly, along the rear edge 40, four patrons can easily be accommodated, while along each of the side edges three patrons may be accommodated.

Stools or chairs 46 are provided along the back edge 40, while stools or chairs 48 are provided along the side edges 30*b* and 30*c*. It will be appreciated that the size of the table may be only to accommodate six patrons if desired, where two patrons would be accommodated at each side of the table. However, it is preferable that ten patrons are accommodated so as to accommodate two teams of five each. The area on the tabletop is sized to provide adequate spaces for placement of food to eat and beverages to drink, as well as scoring equipment. Accordingly, where ten bowlers or patrons are using a pair of alleys, table space is provided for each patron to have food and/or beverages served at the table, as well as space for scoring the games played on the alleys. The table as sized above provides about twenty square feet of tabletop area.

While simple stools having a round seat supported on a pedestal are illustrated, it may be appreciated that any type of stool or swivel chair, both stationary and movable, may be provided at the desired height to allow the patron to comfortably sit at the table. Preferably, the table would be between 36 and 42 inches off the floor to accommodate either counter- or bar-height stools or chairs.

While the tables 30 and 32 are shown to have three legs, it may be appreciated that any number of legs may be provided for support of the tabletop. Moreover, any suitable framework may be provided to support and/or reinforce the tabletop and to which the legs may be secured.

Although the preferred embodiment shows a triangular table, any shape and size of the table may be provided which allows adequate space for the seating and movement of at least six patrons. Moreover, the shape of the table should be such as to allow freedom of movement to and from the table and the approach section and ball return rack.

The corners of the tables are suitably rounded to avoid the exposure of patrons to sharp corners. Further, the table may be trapezoidally shaped wherein it would include a side edge opposite the base edge and parallel to the base edge that may accommodate one or more patrons. In such an embodiment, the trapezoidal shape must provide ample room for a sufficient number of patrons as well as the freedom of access between the lanes and to the approach areas or sections.

It will be understood that modifications and variations may be effected without departing from the scope of the novel concepts of the present invention, but it is understood that this invention is to be limited only by the scope of the appended claims.

The invention is hereby claimed as follows:

1. In a bowling center having a bowling lane section, an approach section and a sitting/scoring section, said bowling lane section including pairs of lanes having front ends that divide the approach section from the bowling lane section, a ball return track disposed between the lanes of a pair of lanes and running the entire length of the lanes to a ball return rack in the approach section between a pair of lanes, said approach section including an open area on each side of the ball return rack allowing a bowler to run up to a lane and release a bowling ball down the lane, said sitting/scoring section being adjacent to and on the side of the approach section opposite from the bowling lane section, and a sitting/scoring table located in the sitting/scoring section, the improvement being in the sitting/scoring table, said table being substantially triangular in shape and including a tabletop defined by a base edge and two substantially equal length side edges, means for supporting said tabletop at an elevation for accommodating a plurality of patrons, said base edge extending substantially parallel to said ends of said lanes, said side edges extending from the base edge and to a point disposed behind the ball return rack, wherein said table is sized to allow for at least six patrons to sit at said table and eat food and drink beverages from said tabletop, and said side edges being disposed to define open areas on each said side of said table and between said table and said ball return rack to allow for said patrons to walk toward said ball return rack and said approach section.

2. The table of claim 1, wherein the length of said base edge will accommodate at least two patrons.

3. The table of claim 2, wherein the length of said side edges will accommodate at least two patrons.

4. The table of claim 1, wherein said table is sized and shaped to accommodate ten patrons.

5. The table of claim 1, wherein said base edge is arcuate in shape.

6. A bowling table for use between two adjacent bowling lanes in a bowling center, wherein the bowling center has a bowling lane section, an approach section disposed behind the bowling lane section and a sitting/scoring section disposed behind the approach section to allow for patrons to sit and keep score, wherein the two bowling lanes include a foul line that divides the approach section from the bowling lane section of each lane and a ball return track located between the two bowling lanes, wherein the ball return track leads to a ball return rack located in the approach section of said lanes, wherein said approach section allows bowlers to run up and deliver a bowling bowl down the bowling lanes, said bowling table in the sitting/scoring section comprising:

a base edge, two side edges, a tabletop, and means for supporting said tabletop, said base edge extending substantially parallel to said foul line, said side edges connecting at an apex aligned with and spaced from said ball return rack, said tabletop sized and shaped for accommodating at least six of said patrons to eat food and drink beverages, and said side edges being disposed to define open areas on each said side of said table and between said table and said ball return rack to allow for said patrons to walk toward said ball return rack and said approach section and in between said lanes.

7. The table of claim 6, wherein said base edge is about eight feet in length.

8. The table of claim 7, wherein said side edges are about six feet six inches in length.

9. The table of claim 6, wherein said table is sized and shaped to accommodate ten patrons, four along the back edge and three along each of said side edges.

10. A bowling table for use between two bowling lanes in a bowling center, wherein the bowling center has a bowling lane section, an approach section disposed behind the bowling lane section, and a sitting/scoring section disposed behind the approach section to allow patrons where said table is located, wherein the two bowling lanes include a foul line that divides the approach section from the bowling lane section and a ball return track located in between the two bowling lanes, and wherein the ball return track ends in a ball return rack in the approach section which has open areas on either side that define an area for bowlers to run up and deliver a bowling ball down the bowling lanes, said bowling table comprising:

a tabletop having a center, means for supporting said tabletop, a base edge having two ends, two side edges, wherein said side edges are substantially straight and extend inwardly from said ends of said base edge, wherein said table is located in said sitting/scoring section and said center of said tabletop is substantially located in line with said ball return rack, wherein said tabletop is sized to accommodate at least six patrons for eating food and drinking beverages, and wherein said side edges and said tabletop are configured to define open areas to allow said patrons to walk to said ball return rack in said approach section and between said lanes.

11. The table of claim 10, wherein the table is triangularly shaped.

12. The table of claim 10, wherein the table is trapezoidally shaped.

13. The table of claim 10, wherein the table is sized to accommodate ten patrons.

* * * * *

UNITED STATES PATENT AND TRADEMARK OFFICE

CERTIFICATE OF CORRECTION

PATENT NO. : 6,572,484 B1
DATED : June 3, 2003
INVENTOR(S) : Mark Thomas Iverson It is certified that error appears in the above-identified patent and that said Letters Patent is hereby corrected as shown below:

Column 2,
Line 56, change the first occurrence of “section” to -- return --;

Column 5,
Line 22, change “between” to -- in combination with --;
Line 31, change “of” to -- between --;
Line 34, after “table” insert -- mounted --; and after “section” insert -- of said lanes and --;
Line 35, before “a base edge,” insert -- a tabletop having -- and delete “a tabletop,”;

Column 6,
Line 8, change “between” to -- in combination with --;
Line 12, after “patrons” insert -- to sit and score --;
Line 17, after “section” insert -- between said lanes --;
Line 27, after “with” insert -- and behind --.

Signed and Sealed this

Twenty-third Day of September, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,572,484 B1
DATED : June 3, 2003
INVENTOR(S) : Mark Thomas Iverson It is certified that error appears in the above-identified patent and that said Letters Patent is hereby corrected as shown below:

Column 5,
Line 33, change “bowl” to -- ball --.

Signed and Sealed this

Fourth Day of November, 2003

JAMES E. ROGAN
*Director of the United States Patent and Trademark Office*